US005161402A

United States Patent [19]

Iwata et al.

[11] Patent Number: 5,161,402

[45] Date of Patent: Nov. 10, 1992

[54] CHAMFERING PRESSING MACHINE

[75] Inventors: Yukio Iwata; Hikoji Kusaki, both of Saitama, Japan

[73] Assignee: Akebono Brake Industry Co., Ltd., Tokyo, Japan

[21] Appl. No.: 730,650

[22] Filed: Jul. 16, 1991

[30] Foreign Application Priority Data

Aug. 6, 1990 [JP] Japan ..... 2-208919

[51] Int. Cl.[5] ..... B21D 28/02

[52] U.S. Cl. ..... 72/336; 72/329

[58] Field of Search ..... 72/327-330, 72/335-337, 333, 339

[56] References Cited

U.S. PATENT DOCUMENTS

| | | | |
|---|---|---|---|
| 1,434,190 | 10/1922 | Bird | 72/329 |
| 1,796,781 | 3/1931 | Fullman | 10/86 F |
| 3,670,383 | 6/1972 | Gavrun | 72/336 |
| 4,142,396 | 3/1979 | Deveney et al. | 72/336 |
| 4,586,360 | 5/1986 | Jurgensmeyer | 72/329 |
| 4,876,876 | 10/1989 | Ishida | 72/335 |

FOREIGN PATENT DOCUMENTS

| | | | |
|---|---|---|---|
| 2227806 | 12/1973 | Fed. Rep. of Germany | 72/333 |
| 3813353A1 | 11/1989 | Fed. Rep. of Germany . | |
| 2368318 | 5/1978 | France . | |
| 1433616 | 10/1988 | U.S.S.R. | 72/333 |
| 1253072 | 11/1971 | United Kingdom | 72/330 |

OTHER PUBLICATIONS

Abstract of Japanese Appln. No. 59-209443(A), dated Nov. 28, 1984.

*Primary Examiner*—Daniel C. Crane

*Attorney, Agent, or Firm*—Finnegan, Henderson, Farabow, Garrett and Dunner

[57] ABSTRACT

A chamfering pressing machine including a blanking-chamfering section having a die, in which the die has a shearing die section, a chamfering die section and a guide section, a punch for shearing a sheet of material to form a product, the sheet of material being placed on said blanking-chamfering section, and a cushioning pad received in said die capable of an upward and downward movement so as to support said product.

10 Claims, 4 Drawing Sheets

CHAMFERING PRESSING MACHINE

BACKGROUND OF THE INVENTION

1. Field of the Invention

This invention relates to a chamfering pressing machine for chamfering and shearing materials, such as a metal sheet of coil-like stock, to form uniform products of a particular shape.

2. Discussion of the Related Art

A conventional chamfering pressing machine, as shown in FIG. 7, comprises a chamfering die 20 and a chamfering punch 21, and uses a coil-like stock 22. Springs 28*a* of a stripper 28 forces the coil-like stock 22, subjected to a shearing operation, toward the chamfering punch 21.

The coil-like stock 22 is fed by a feed device (not shown), such as a roll feeder, in the direction of arrow A as shown in FIG. 6, and is subjected to various operations. First, a chamfered portion 23 is formed by the chamfering die 20 and the chamfering punch 21, and then holes 24 are formed. Subsequently, a product 25 having a chamfered portion 25*a* and holes 24 is formed by a shearing operation through a blanking die 26 and a blanking punch 27. In order to form the product 25 by shearing, holes 24 are used as positioning means, and from this position, the chamfered portion 23 is sheared. Therefore, as shown in a lower portion of FIG. 6, the chamfered portion 25*a* is formed on one edge of the product 25.

However, such a conventional chamfering pressing machine has the following problems:

(1) The chamfered portion 23 is formed in the coil-like stock 22, and therefore, even if the chamfered portion 23 is formed uniformly, the thickness of the chamfered portion 25*a* of the product 25 becomes uneven because of backlash formed in a take-up holder portion for the coil-like stock 22 and in the positioning means provided by the holes 24. As a result, the position of the chamfering punch 21 must be adjusted frequently.

(2) As shown in an enlarged scale in FIG. 8, when the chamfered portion 23 is formed by the chamfering die 20 and the chamfering punch 21, one side of the coil-like stock 22 is restrained by the positioning means provided by the holes 24, and the other side thereof is restrained by the taken-up or rolled portion of the coil-like stock 22. Therefore, the squeezed or pressed material of the stock cannot escape anywhere. As a result, a high working pressure is required.

(3) When the chamfered portion 23 is formed by the chamfering die 20 and the chamfering punch 21, in the vicinity of the chamfering punch 21, the material of the stock is raised in the direction of the thickness of the stock and moved in the feed direction A, as indicated by arrows in FIG. 8, to cause deformation and adversely affect the flatness of the product 25.

(4) When the chamfering punch 21 and the blanking punch 27 are disposed close to each other as shown in FIG. 7, a space for accommodating these punches can be reduced; however, since the directions of movement of the two punches 21 and 27 are opposite, the coil-like stock 22 is undesirably bent or deformed, thereby adversely affecting the flatness of the product 25.

SUMMARY OF THE INVENTION

The present invention has been made in view of the above circumstances and has as an object of solving the above mentioned problems.

Another object of the present invention is to produce a chamfered product having a uniform size, precise shape, and sufficient flatness without requiring high pressure.

A further object of the present invention is to reduce the number of steps involved in transferring the blank and to reduce the space for accommodating the blanks.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the chamfering pressing machine of this invention comprises a blanking-chamfering section having a die, a punch for shearing a stock placed on the blanking-chamfering section to form a product, and a cushioning pad received in the die for upward and downward movement for supporting the product. The die of the blanking-chamfering section has a shearing die section provided at the upper end portion and corresponding in shape to the punch, a chamfering die section having a slanting surface extending from the shearing die section and slanting gradually downward, and a guide section extending from the chamfering die section and serving to guide the cushioning pad.

BRIEF DESCRIPTION OF THE DRAWINGS

The accompanying drawings, which are incorporated in and constitute a part of this specification, illustrate the embodiment of the invention and, together with the description, serve to explain the objects, advantages and principles of the invention. In the drawings.

DETAILED DESCRIPTION OF THE PREFERRED EMBODIMENT

Figure 1:
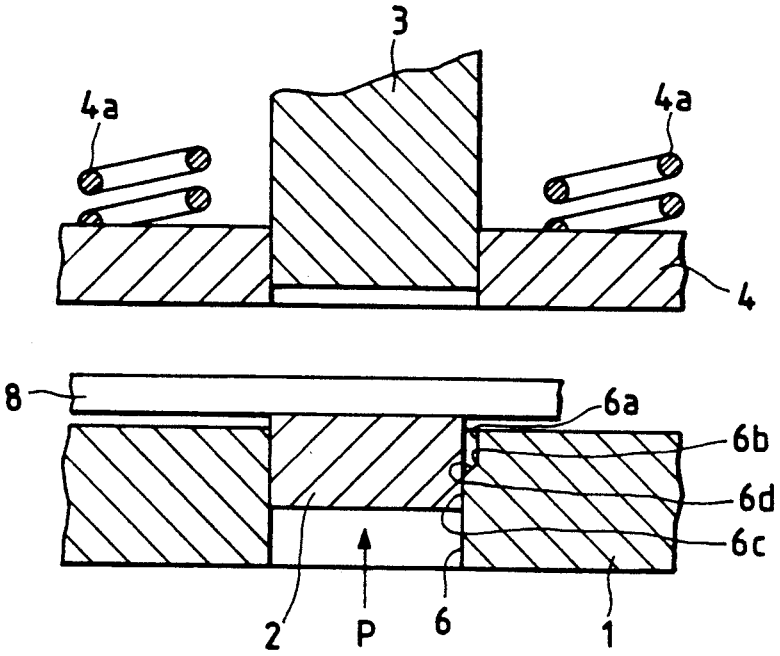
FIG. 1 is a cross-sectional view of an important portion of the ,chamfering pressing machine.

In the chamfering pressing machine of the above construction, the product of a predetermined shape is produced from the stock by shearing and chamfering operations. Before the shearing and chamfering operations, however, the stock is disposed between a blanking-chamfering section having a die and a punch for producing a blank or a blanking punch.

In this condition, the pressing machine is operated to lower the blanking punch. As a result, the stock is stamped by the shearing die section to form a blank of a predetermined shape. At this time, the lower surface of the blank is resiliently supported by the cushioning pad, and therefore, the blank is prevented from undesired deformation. The ruptured surface of the blank formed by shearing has a shear droop at the lower end portion, a bulge portion continuous with this shear droop, and a recess above the bulge portion.

The blanking punch is further lowered so as to lower the blank past the shearing die section to the chamfering die section, while the lower surface of the blank is resiliently supported by the cushioning pad, so that the lower edge of the blank (specifically, the shear droop portion) is pressed against the slanting surface. At this time, since the blanking punch has a shape corresponding to that of the shearing die section, almost the entire upper surface of the blank is contacted by the lower surface of the blanking punch, and therefore prevented from undesired deformation. The portion in the vicinity of the shear droop is desirably deformed to form the chamfered portion. The deformed material in the vicinity of the shear droop enters the recess disposed above the bulge portion, so that the thickness of the material is hardly changed in the direction of the sheet thickness.

After the product of the predetermined shape is produced, the blanking punch is returned upward. Also, the product is forced upward by the cushioning pad to be fitted into a stamping space from which the product has been removed, and then the product is transferred with the skelton.

A preferred embodiment of the present invention will now be described with reference to the drawings.

FIGS. 1 to 5 show one preferred embodiment of this invention. A blanking-chamfering section 1 is mounted on a support (not shown). A die portion 6 of the blanking-chamfering section 1 has a shearing die section 6*a*, a chamfering die section 6*b* and a guide section 6*c* which are arranged in this order from the upper end of the die portion 6. The shearing die section 6*a* has a cross-sectional shape corresponding to that of a blanking punch 3 disposed in opposed relation to the blanking-chamfering section 1. The gap (FIG. 4) between the two members 1 and 3 is about 7 mm. The chamfering die section 6*b* has a slanting surface 6*d* which extends from the shearing die section 6*a* and is gradually slanted downward. The slanting surface 6*d* is provided at one side where the chamfering is to be effected. The guide section 6*c*, extending from the chamfering die section 6*b*, has a cross-sectional shape corresponding to that of a cushioning pad 2 so that the guide section can guide the cushioning pad.

The cushioning pad 2 is made of metal, and receives a cushioning pressure P in the form of either a pneumatic or a hydraulic pressure so that the cushioning pad 2 can move upward and downward in the die portion 6 of the blanking- chamfering die 1. The cushioning pad is movable by the cushioning pressure P between an upper position (FIG. 1) where the cushioning pad is projected slightly above from the upper surface of the blanking-chamfering section 1 so as to engage the shearing die section 6*a* and a lower position (FIG. 4) where the cushioning pad engages the guide section 6*c*.

Figure 5:
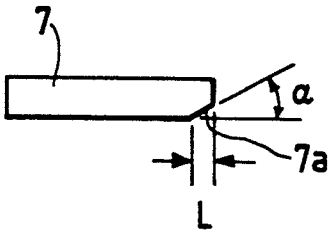
FIG. 5 is a view showing a product of the present invention.
Figure 6:
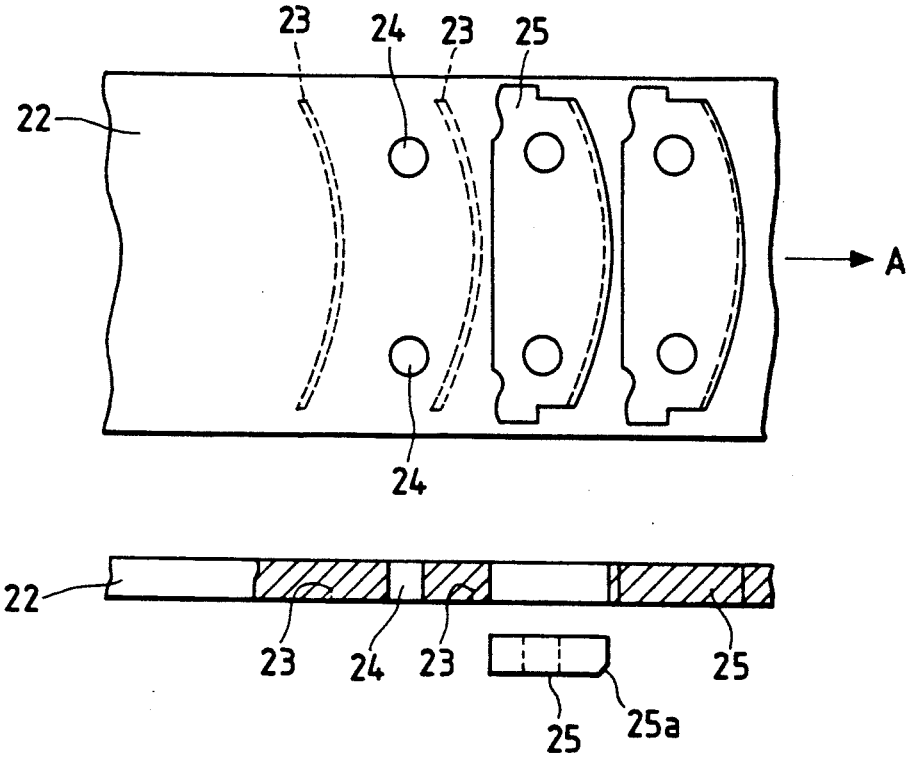
FIG. 6 PRIOR ART
FIG. 6 is an explanatory view of the production process of a conventional chamfering pressing machine.
Figure 7:
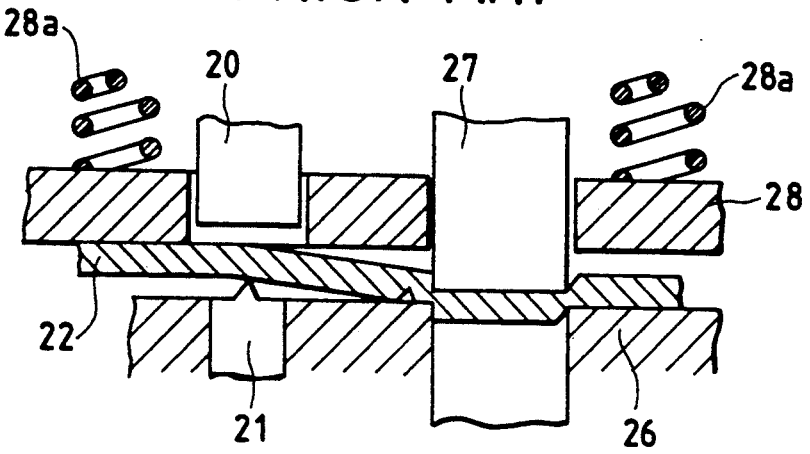
FIG. 7 PRIOR ART
FIG. 7 is an explanatory view of operations of a chamfering punch and a blanking punch of a conventional chamfering pressing machine.
Figure 8:
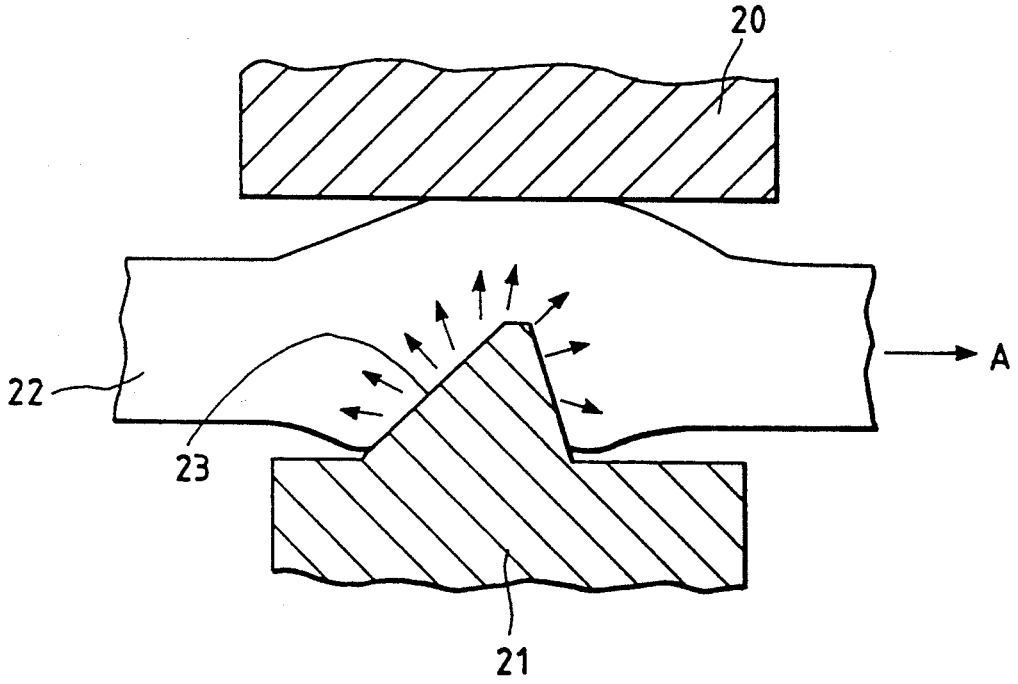
FIG. 8 PRIOR ART
FIG. 8 is an explanatory view of the operation of the chamfering punch of a conventional chamfering pressing machine.

A stripper 4 is attached to the blanking punch 3 disposed in opposed relation to the blanking-chamfering section 1. Thus, the stripper 4 has the function of removing the skeleton, fitted on the blanking punch 3, after a product 7 (the blank), shown in FIG. 5, is subjected to shearing and chamfering operations. The stripper 4 surrounds the blanking punch 3, and is resiliently forced downward by springs 4*a*.

A coil-like stock 8 (specifically, a steel sheet having a thickness of about 5 mm) is intermittently fed by a feed device (not shown) to a position between the blanking punch 3 and the blanking-chamfering section 1, that is, onto the cushioning pad 2 held at its upper position by the cushioning pressure P.

The operation of the chamfering pressing machine of the present invention will now be described.

The product 7 of a predetermined shape (specifically, a back metal of a friction pad of a floating caliper-type disk brake) as shown in FIG. 5 is produced from the coil-like stock 8 by shearing and chamfering operations. Before the shearing and chamfering operations, however, the coil-like stock 8 is placed on the cushioning pad 2 and is disposed between the blanking-chamfering section 1 and the blanking punch 3, as shown in FIG. 1.

Figure 2:
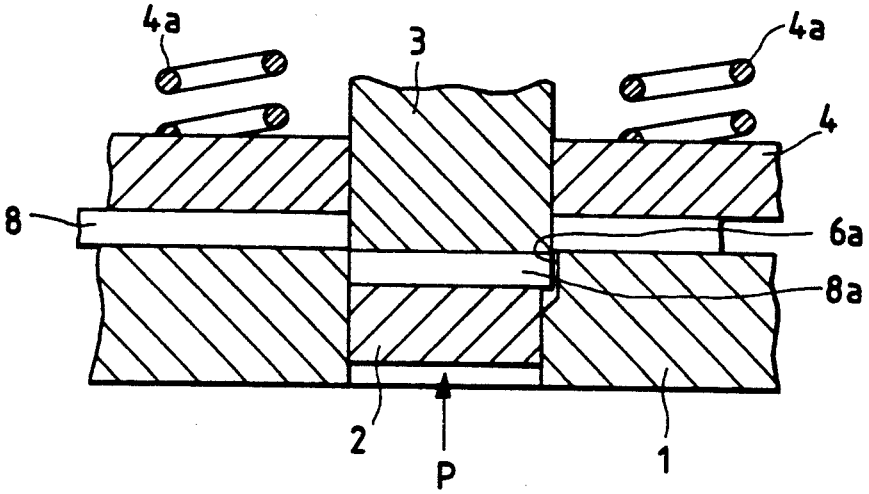
FIG. 2 is an explanatory view of the operation of the chamfering pressing machine.
Figure 3:
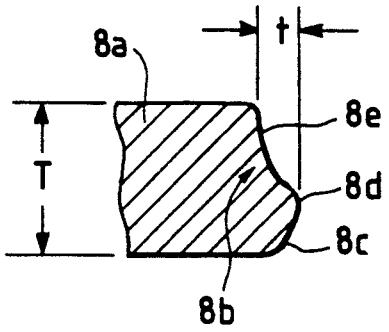
FIG. 3 is a view showing a rupture surface of a blank.
Figure 4:
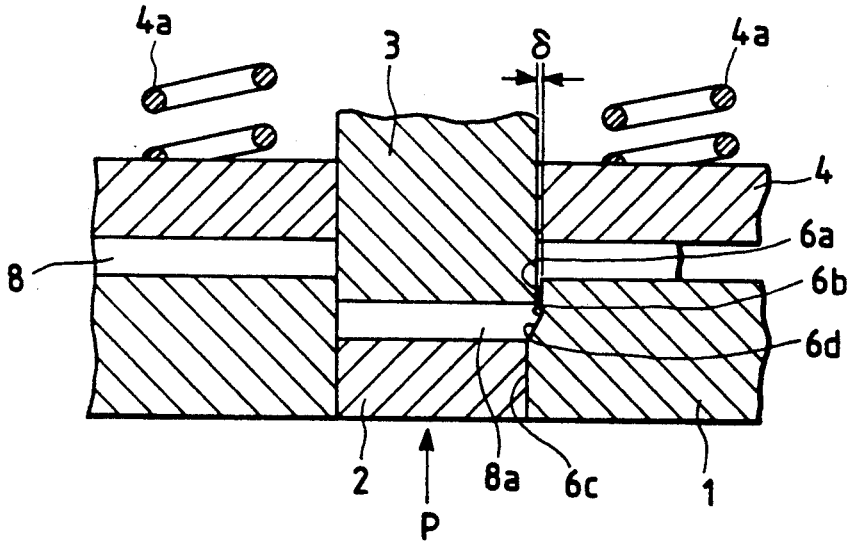
FIG. 4 is an explanatory view of the operation of the chamfering pressing machine.

In this position, the pressing machine is operated to lower the blanking punch 3. As a result, the coil-like stock 8 is stamped by the shearing die section 6*a* to produce a blank 8*a* through the shearing operation, as shown in FIG. 2. At this time, the lower surface of the blank 8*a* is resiliently supported by the cushioning pad 2 having the cushioning pressure P, and therefore is prevented from undesired deformation. As a result of the shearing of the blank 8*a*, a rupture surface 8*b* is formed which has a shear droop 8*c* at its lower end portion, a bulge portion (sheared surface) 8*d* continuous with this shear droop 8*c*, and a recess 8*e* above the bulge portion 8*d*, as shown in an enlarged scale in FIG. 3. The amount of the bulge of the bulge portion 8*d* is about 0.7 mm when the sheet thickness T is about 5 mm.

The blanking punch 3 is further lowered to force the blank 8*a* past the shearing die section 6*a* to the chamfering die section 6*b*, while the lower surface of the blank is supported by the cushioning pad 2, so that the lower edge portion of the blank 8*a*, that is, the shear droop 8*c*, is pressed by the slanting surface 6*d*. The blanking punch 3 has a shape to fit in the shearing die section 6*a* with a slight gap therebetween, and therefore, almost the entire upper surface of the blank 8*a* is in contact with the lower surface of the blanking punch 3. Hence, the blank 8*a* is prevented from undesired deformation, and the portion of the blank in the vicinity of the shear droop 8*c* is desirably deformed to form a chamfered portion 7*a*, as shown in FIG. 5. The deformed material in the vicinity of the shear droop 8*c* enters the recess 8*e* disposed above the bulge portion 8*d*, so that the thickness of the material is hardly changed. Additionally, the chamfered portion 7*a* is provided, for example, for the purpose of preventing the concentration of stress resulting from local contacts with other parts.

With respect to the dimensions of the chamfered portion provided for this purpose, the slanting angle relative to the lower surface of the product 7 is preferably about 30°, and the width L is about $3 \pm 0.5$ mm.

After the product 7 of the predetermined shape is produced, the blanking punch 3 is returned upward. Also, the product 7, formed as a result of the stamping of the blank 8*a*, is forced upward by the cushioning pad 2 to be fitted into a stamping space from which the product has been removed, and then the product is transferred with the skelton.

As will be appreciated from the above description, in the chamfering pressing machine of the present invention, the following practical advantages can be obtained:

(1) Since the operation on the chamfered portion is effected with respect to the blank, the chamfered portion is not displaced out of position. Therefore, the chamfered portion has a uniform size and a highly precise shape.

(2) The chamfered portion of the product is formed by pressing the shear droop portion, effectively using the recess, produced in the rupture surface by the shearing as a stress relief portion for the pressed material. Therefore, a high working pressure is not needed.

(3) The chamfered portion of the product is formed with the upper and lower surfaces supported by the blanking punch and the cushioning pad, respectively, and a small amount of the pressed material moves into the recess formed in the rupture surface by the shearing. Therefore, the product has a good flatness.

(4) The shearing operation and the chamfering operation are carried out in the same step, using the blanking-chamfering section and the blanking punch. Therefore, the number of operation steps involving the transfer of the blank is reduced as well as the space for accommodating the blanks.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A chamfering pressing machine for chamfering a material comprising:

a material supporting surface, said material supporting surface having a die opening of a predetermined depth extending in a direction normal to the support surface, said die opening having a first uniform width for a first portion of the depth adjacent the material supporting surface and a second uniform width less than the first uniform width for a second portion of the depth commencing spaced from the first uniform width portion, said die opening having a chamfer surface portion connecting the first and second depth portions said widths being measured along lines extending parallel to said supporting surface, said second depth portion located at a greater distance from said supporting surface than said first depth portion;

a cushion pad having a configuration and dimension corresponding to the second depth portion of the die opening mounted to slide in the second depth portion and urged in a direction toward the material supporting surface; and a one piece punch mounted to move in a direction normal to the supporting surface, said punch having a planar end surface with a configuration substantially corresponding to the first depth portion and uniform width less than the first depth portion and greater than the second depth portion, said end surface being aligned with the die opening for movement into the first depth portion such that said punch is incapable of entering said second depth portion, said punch and cushion pad engaging opposite sides of said material during punching so that the material is moved into said first portion depth until said material is chamfered by said chamfer surface portion.

2. The chamfering pressing machine according to claim 1, wherein said die opening has a uniform planar side opposite the side having the chamfer surface portion and extending from the first portion to the second portion.

3. The chamfering pressing machine according to claim 1, wherein a difference between the width of the punch and the width of the first depth portion defines a space for receiving a portion of material deformed from the sheared sheet during formation of a chamfer.

4. The chamfering pressing machine according to claim 1, wherein a difference between the width of the first depth portion and the width of the punch is greater than the thickness of the material.

5. The chamfering pressing machine according to claim 1, wherein said chamfer surface is a slating surface extending from said first portion and slanting gradually downward to said second portion.

6. The chamfering pressing machine according to claim 5, wherein said chamfer surface is slanted at an angle of approximately 30° relative to the normal direction of the material supporting surface.

7. The chamfering pressing machine according to claim 5, wherein said chamfer surface has a width approximately in the range of 2.5 mm to 3.5 mm.

8. A method for chamfering a metallic material using a chamfering pressing machine including a one piece punch, a cushion pad, and a material supporting surface having a die opening, said die opening including a first uniform width for a first portion of the depth and a second uniform width less than the first uniform width for a second portion of the depth, said widths being measured along lines extending parallel to said supporting surface, said second depth portion located at a greater distance from said supporting surface than said first depth portion said die opening having a chamfer surface portion connecting the first and second depth portions, wherein a difference between the width of the first portion and a width of the punch defines a space with the punch being incapable of entering the second portion of the depth, the method comprising the steps of:

positioning the metallic material on said material supporting surface;

shearing a portion of the metallic material by moving said one piece punch in a direction normal to the supporting surface and creating a deformed portion on the sheared material, wherein the punch forces the sheared material to enter the first portion;

pressing the sheared material into contact with the chamfer surface portion by moving said punch further in the direction normal to the supporting surface and into said first portion, wherein the sheared material is supported by the cushion pad during the shearing and pressing steps; and forming a chamfer portion on the sheared material by moving the punch into only the first depth to force the sheared material onto the chamfer surface portion while receiving in the defined space a portion of material deformed from the sheared material during formation of the chamfer.

9. The method according to claim 8, wherein the forming step form said chamfer that is slanted at an angle of approximately 30° relative to the normal direction of the material supporting surface.

10. The method according to claim 8, wherein the forming step forms said chamfer having a width approximately in the range of 2.5 mm to 3.5 mm.

* * * * *

UNITED STATES PATENT AND TRADEMARK OFFICE

CERTIFICATE OF CORRECTION

PATENT NO. : 5,161,402

DATED : November 10, 1992

INVENTOR(S) : Yukio Iwata et al.

It is certified that error appears in the above-identified patent and that said Letters Patent is hereby corrected as shown below:

On title page, item [54], change "kusaki" to --Kusaka--

Claim 1, Column 5, Line 47 change "support" to --supporting--;

Claim 1, Column 5, Line 54 after "portions" insert --,--.

Claim 5, Column 6, Line 25 change "slating" to --slanting--.

Claim 9, Column 7, Line 6 chnage "form" to --forms--.

Claim 8, Column 6, Line 45 before "said" insert --,--.

Signed and Sealed this

Eighteenth Day of January, 1994

Bruce Lehman

*Attest:*

BRUCE LEHMAN

*Attesting Officer*

*Commissioner of Patents and Trademarks*